US005628401A

United States Patent [19]

Broeders

[11] Patent Number: 5,628,401

[45] Date of Patent: May 13, 1997

[54] STACKABLE BEER CONTAINER WITH FLUID COUPLING

[75] Inventor: Franciscus Broeders, Dongen, Netherlands

[73] Assignee: Allied Breweries Nederland B.V., CA Breda, Netherlands

[21] Appl. No.: 685,878

[22] Filed: Jul. 24, 1996

Related U.S. Application Data

[63] Continuation of Ser. No. 495,887, Jun. 28, 1995, abandoned.

[51] Int. Cl.[6] ..... B65D 21/032

[52] U.S. Cl. ..... 206/509; 220/DIG. 1; 220/23.6

[58] Field of Search ..... 206/509, 511, 206/512; 220/23.6, 23.4, 23.2, DIG. 1

[56] References Cited

U.S. PATENT DOCUMENTS

| | | | |
|---|---|---|---|
| T947,001 | 6/1976 | Mavredes | 220/23.6 |
| 2,219,072 | 10/1940 | King | 220/DIG. 1 |
| 5,105,858 | 4/1992 | Levinson | 206/509 |
| 5,417,329 | 5/1995 | Whitman | 206/509 |

FOREIGN PATENT DOCUMENTS

| | | | |
|---|---|---|---|
| 2723963 | 12/1978 | Germany | 206/509 |
| 160657 | 9/1957 | Sweden | 206/509 |

*Primary Examiner*—Stephen J. Castellano
*Attorney, Agent, or Firm*—Brumbaugh, Graves, Donohue & Raymond

[57] ABSTRACT

A beer container comprising a metal, pressure-resistant barrel (1) for beer and a block-shaped housing (2) surrounding the barrel, which housing has a bottom surface whose dimensions correspond to those of a conventional crate for beer bottles and, at the top and bottom sides thereof, comprises means (3, 4) for enabling it to be stacked with housings of corresponding beer containers, and each barrel comprising a fluid coupling (6, 7) for enabling the interior thereof to be coupled with the interior of the barrel of a superjacent and/or subjacent container. Through these measures, a beer container is obtained that can readily be displaced and transported in a compact stack, and the user may realize one single container with the desired capacity by coupling a number of stacked containers.

11 Claims, 5 Drawing Sheets

STACKABLE BEER CONTAINER WITH FLUID COUPLING

This application is a continuation of application Ser. No. 08/495,887, filed on Jun. 28, 1995 now abandoned.

BACKGROUND OF THE INVENTION

The invention relates to a beer container comprising a metal pressure-resistant barrel for beer and a block-shaped housing surrounding the barrel.

Such a beer container is disclosed in DE-A-3913643 and is intended to be used as a so-called "home tap" and comprises a connection for the feed of carbonic acid gas by means of a $CO_2$-cartridge and a connection for a tap rod to be inserted into the barrel from above.

Because of the limited capacity of the barrel, this known container is not suitable for use in bars, restaurants, etc. At present, for applications in bars, restaurants, etc., metal cylindrical beer containers are used having a capacity of 30 or 50 liters. These containers have the drawback that they are rather vulnerable and in particular that their weight, in full condition, is high, which weight will soon even no longer be allowed in view of the legislation in the field of labor conditions ("ARBO" Act).

SUMMARY OF THE INVENTION

The object of the invention is to provide a solution to this, and to that end it provides a beer container of the above-mentioned type, characterized in that the housing has a bottom surface whose dimensions correspond to those of a conventional crate for beer bottles, that the housing, at the top and bottom sides thereof, comprises means for enabling it to be stacked with housings of corresponding beer containers and that each barrel comprises means for enabling the interior thereof to be coupled with the interior of the barrel of a superjacent and/or subjacent container.

Through the measures of the invention, a beer container is provided having a number of evident advantages both compared with conventional metal containers and compared with the above-described home tap.

Compared with the conventional container, a first advantage is the lower weight, for instance less than 25 kg at a barrel contents of 15–20 liters, while this smaller capacity has no practical drawbacks because the containers can readily be coupled. A second advantage is that logistically, the containers have a much better shape, because due to their crate shape an optimum packaging density can be realized, both alone and in combination with beer crates with bottles, and, like bottle crates, they can be transported stackwise on pallets. A further advantage is that the crate-shaped housings, preferably manufactured from synthetic material, are less vulnerable and may be provided with handgrips for them to be readily picked up and displaced.

Compared with the home tap containers, the advantage is the possibility of realizing a container with a desired capacity through coupling several barrels together in stacked containers, while here, too, the crate shape is advantageous for the same reasons are described hereinabove.

It is observed that DE-U-9115953 discloses a spherical tank, preferably manufactured from synthetic material and suitable for many purposes, including the storage of liquid. These tanks can be stacked, in which case an opening at the bottom side of a tank couples with an opening at the top side of a subjacent tank. However, in respect of both purpose and shape, these known spherical tanks differ completely from the beer container according to the invention.

BRIEF DESCRIPTION OF THE DRAWING

Hereinafter, the invention will be further explained on the basis of an exemplary embodiment with reference to the accompanying drawings. In these drawings.

DETAILED DESCRIPTION OF PREFERRED EMBODIMENTS

Figure 1A:
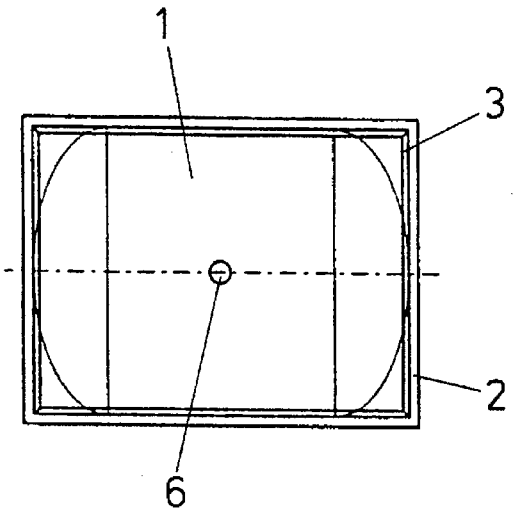
FIG. 1*a, b* are a top plan view and a side elevation of the container according to the invention.
Figure 1B:
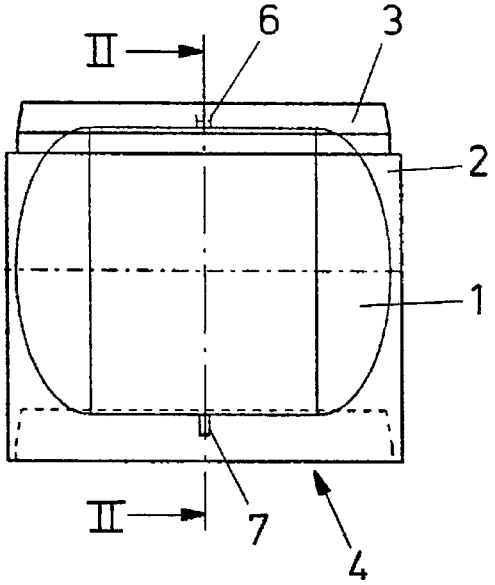

In the Figures, identical parts are designated by identical reference numerals. FIG. 1 shows a beer container according to the invention, comprising a metal beer barrel 1, preferably of a cylindrical shape and surrounded by a block-shaped housing 2. The housing 2 is preferably made of synthetic material and may for instance be jetted around the barrel 1, or the barrel 1 may be clamped in the housing 2. At the top side, the housing 2 comprises coupling means 3, for instance a raised edge or projections adapted to couple with complementarily shaped coupling means 4 at the bottom side of the housing 4, such as a recess or recesses with which the above-mentioned edge or projections can mesh. Obviously, the coupling means at the top and bottom sides of each housing can be changed, as a result of which the recess is at the top and the edge or projections at the bottom. Each housing has a rectangular bottom surface whose dimensions correspond to those of a conventional crate for beer bottles, for instance 30×40 cm. At the narrow upright side handgrips 5 are provided, facilitating the handling of the containers. Provided at the top side of each barrel is a closable feed opening 6 for $CO_2$ gas and profiled at the bottom side is a discharge opening 7 for beer, which opening, in the case of stacked barrels, when one or more barrels disposed at the top of the stack have already been emptied, can also function as a feed opening for $CO_2$ to subjacent barrels. Thus, each barrel comprises connecting means for enabling the interior thereof to be coupled with the interior of the barrel of a superjacent and/or subjacent container. Connecting means are known which afford locking and unlocking.

Figure 2B:
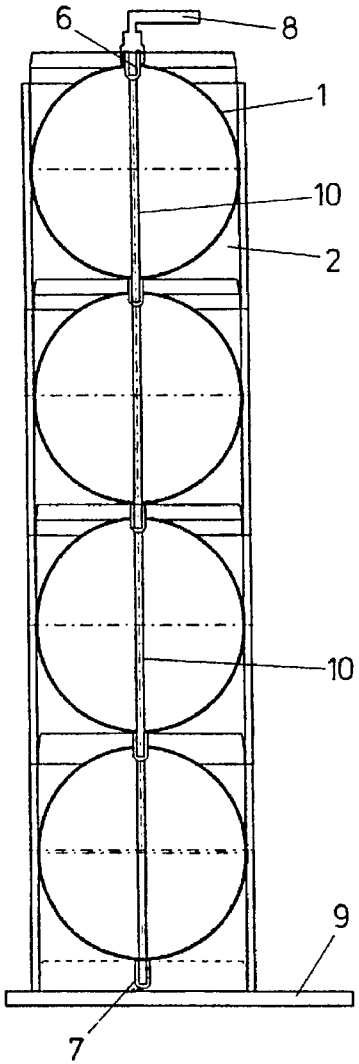
FIG. 2*a* is a side elevation and FIG. 2*b* is a cross section of a number of stacked and coupled containers according to the invention.
Figure 2A:
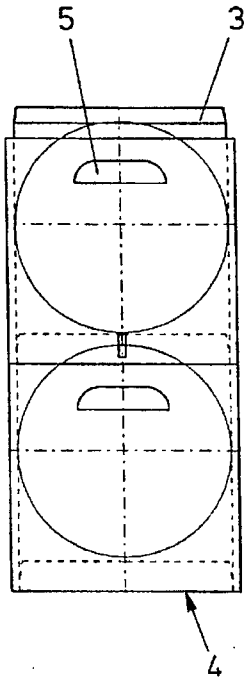

FIG. 2*a* shows, in side elevation, barrels stacked on top of each other for transportation, clearly showing how the coupling means 3 and 4 cooperate. FIG. 2*b* shows four containers according to the invention, such as they may be arranged at a bar, restaurant, etc. In FIG. 2*b*, each of the stacked barrels is shown in cross section taken on the line II—II in FIG. 1*b*, which shows how the feed openings 6 and the discharge openings 7 of the containers stacked on top of each other cooperate. At the top side of the stack, $CO_2$ gas is fed via a conduit 8 to the topmost feed opening 6. The gas fed exerts a downward pressure on the beer in the top barrel, and this pressure is passed on, via the respective openings 6 and 7 in the successive barrels, to the bottom barrel, allowing the beer to be discharged, via a conduit 9 connected to the discharge opening of the bottom barrel, to a tap point.

Obviously, the openings 6 and 7 should be closed during transportation and storage to prevent the loss of beer and/or the ingress of contaminations. To realize this, different solutions are conceivable. For instance, the openings 6 and 7 can be designed to open automatically when the containers are stacked on top of each other, while undesired opening is prevented through a seal that is to be broken after transportion and before putting the containers into service. Also, the openings 6 and 7 may be provided asymmetrically, viewed in the longitudinal direction of the container, so that the openings couple when the containers are stacked in one manner and are clear of one another when the containers are stacked in a position rotated 180° around the vertical axis.

Another manner of coupling the barrels is shown in FIG. 2*b*. Here, a rod 10 is provided between the feed opening 6 and the discharge opening 7 of each barrel, coupling a closing meachanism in the two openings. The construction is such that by means of rotation of the $CO_2$ connection 8 through for instance 90° or 180°, the closing mechanisms in the top container, coupled by the rod 10, are opened and that, as a result, the rods 10 in the bottom barrels are rotated as well to also release the openings 6 and 7 therein. In this manner, with a single, simple operation, i.e. rotating the $CO_2$ connection, any number of stacked containers can be coupled with one another, to create in fact one large container.

Figure 3B:
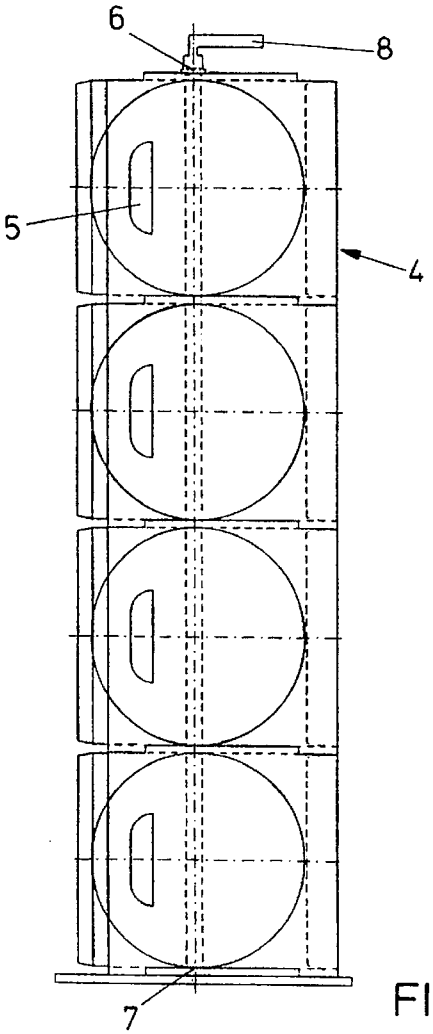
FIG. 3*a, b* are side elevations of a number of containers according to the invention, stacked and coupled in an alternative manner.
Figure 3A:
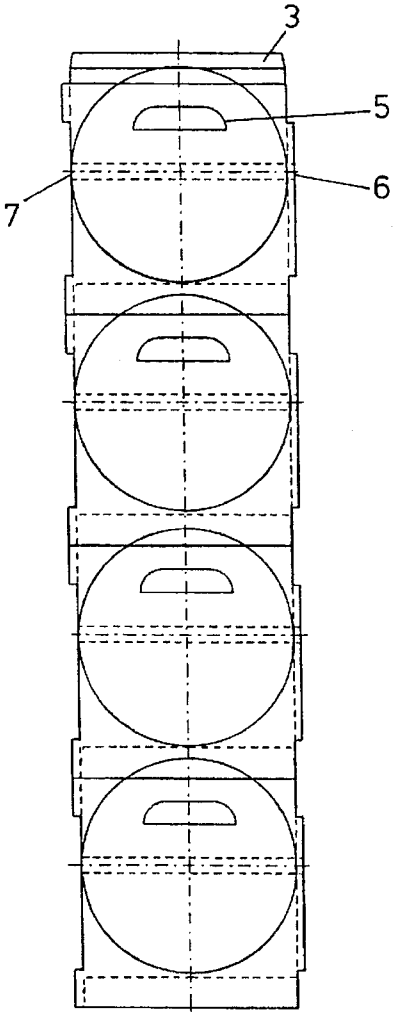

FIG. 3*a, b* show an alternative, wherein the containers are transported in the same manner as shown in FIG. 2*a,* but with the feed opening 6 and the discharge opening 7, viewed in FIG. 3*a,* provided at the center of the long sides of the containers and barrels. The barrels are now coupled to one another by disposing them, as shown in FIG. 3*b,* with their sides on top of each other, with the openings 6 and 7 adapted to be coupled to one another in the same manners as described in respect of FIG. 2*b*. The manner of stacking for coupling the containers as shown in FIG. 3*a, b* has the advantage that the lateral sides of the containers are less exposed to contamination and damages than, in particular, the bottom of the containers, where, in the exemplary embodiment of FIG. 2*a, b*, the discharge opening is located. Also, it is easier to check whether a transport seal is undamaged when it is located on the lateral side of a container during transportation and storage.

Figure 4:
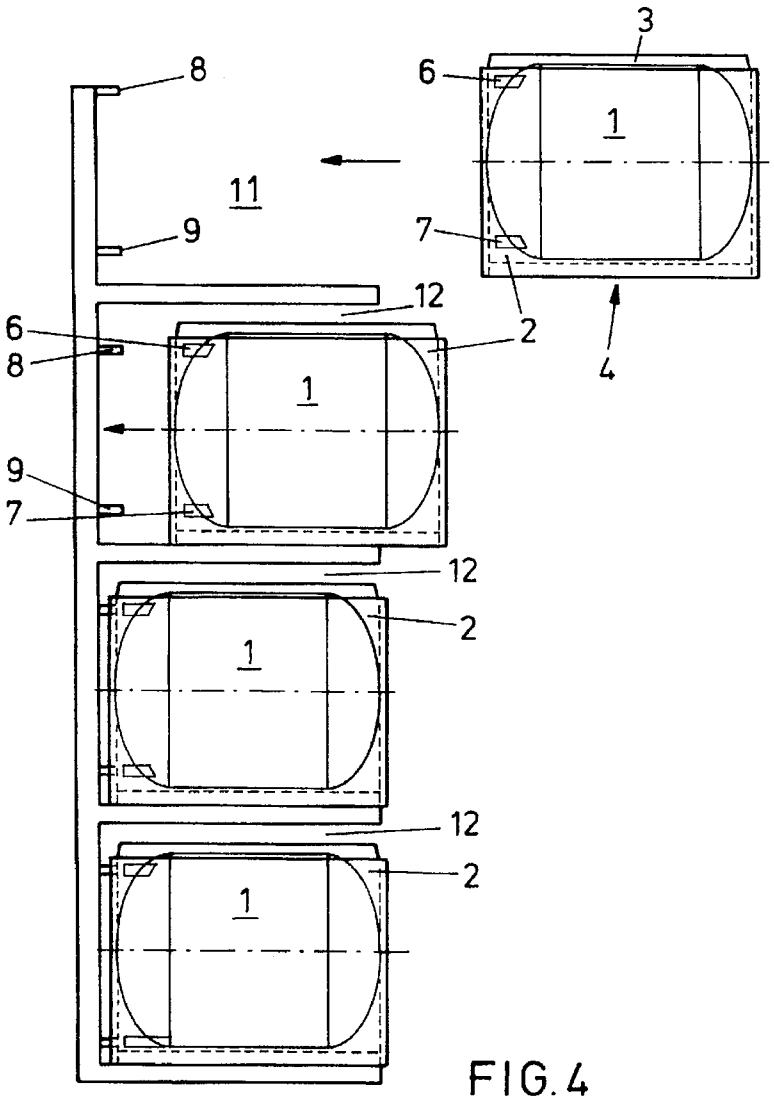
FIG. 4 is a side elevation of a third manner of coupling the containers according to the invention.

FIG. 4 shows a variant wherein the feed opening and the discharge opening are both located, one above the other, on one side of the container, and wherein the containers are stacked in a rack 11 for use, each compartment 12 of the rack containing a container. Each compartment 12 has a $CO_2$ connection 13 and a beer discharge connection 14. Hence, in such an arrangement, the barrels are not coupled internally, but connected in parallel.

Figure 5B:
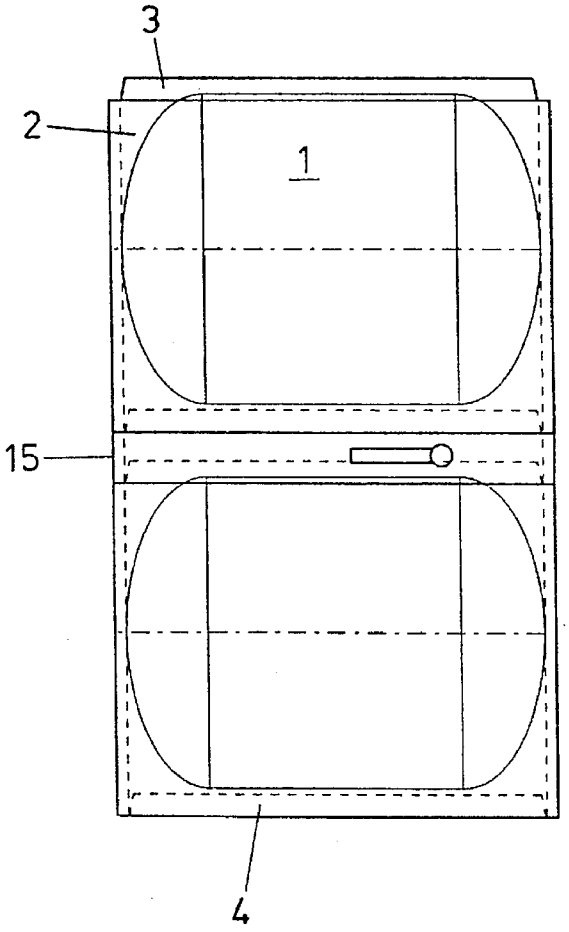
FIG. 5*a, b* are side elevations of a fourth manner of coupling the containers according to the invention.
Figure 5A:
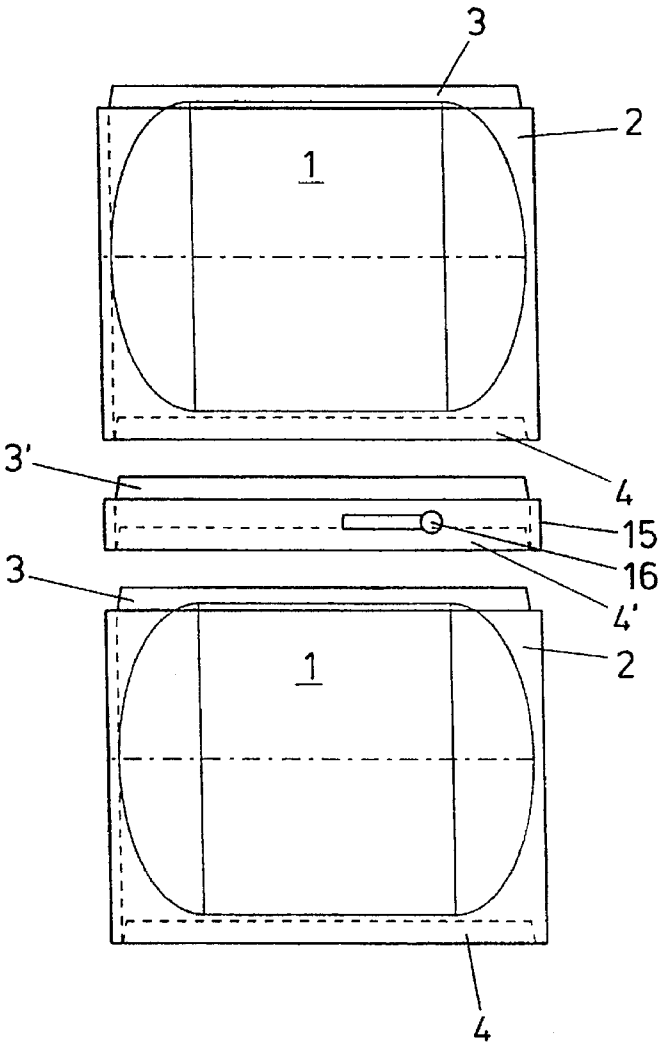

FIG. 5*a* shows an embodiment wherein the containers are coupled to one another by means of a connecting piece 15, as shown in FIG. 5*b*. Each connecting piece is provided with a slidable handle 16 effecting, through the sliding thereof, the intercoupling of the barrels, and with coupling means 3' and 4' having the same shape and function as the coupling means 3 and 4.

Figure 6:
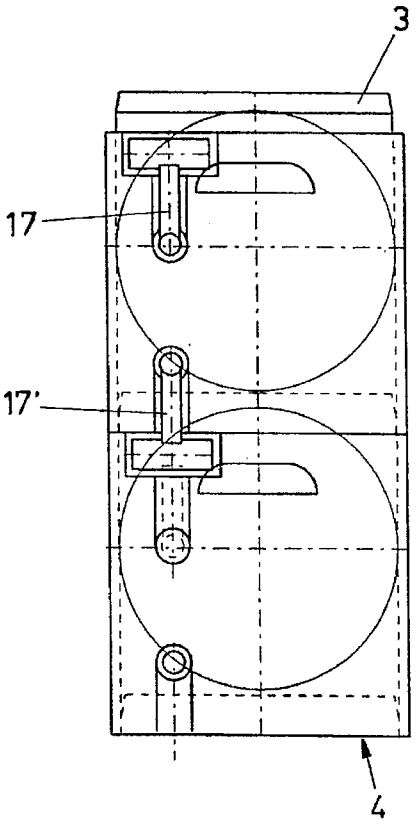
FIG. 6 is a side elevation of a fifth manner of coupling the containers according to the invention.

FIG. 6 shows an embodiment wherein rotatable handles 17, 17' are provided on the lateral side of the housing, which handles serve to lock the coupling mechanism of the openings 6 and 7 in barrels stacked on top of one another, or to unlock them by rotating the handles a quarter of a turn.

Instead of a locking coupling between the successive feed and discharge openings 6 and 7, it is also possible to use a non-locking coupling and to interlock the housings in a detachable manner to prevent the release of the above-mentioned coupling(s) due to the pressure prevailing in the barrels. The coupling of the housings can be effected by means of various releasable snap connections, known per se, but also by, for instance, providing the lateral sides of the housings with vertically movable sections which lock the housings when slid upward or downward.

I claim:

1. A beer container comprising a metal, pressure-resistant barrel for beer and a block-shaped housing surrounding the barrel, characterized in that the housing has a bottom surface whose dimensions correspond to those of a conventional crate for beer bottles, that the housing, at the top and bottom sides thereof, comprises means for enabling it to be stacked with housings of corresponding beer containers and that each barrel comprises connecting means for enabling the interior thereof to be coupled with the interior of the barrel of a superjacent and/or subjacent container.

2. A beer container according to claim 1, characterized in that the connecting means are located at the top side and at the bottom side of the container.

3. A beer container according to claim 1, characterized in that the connecting means are located an opposite lateral sides of the container.

4. A beer container according to claim 2, characterized in that the connecting means are located at the center of the respective side of the container.

5. A beer container according to claim 1, characterized in that the connecting means comprise means for locking them detachably during the coupling thereof.

6. A beer container according to claim 5, characterized in that means are provided for operating the locking from the lateral side of the container.

7. A beer container according to claim 5, characterized in that a coupling element is provided for intercoupling two containers, disposed one above the other, and that said coupling element comprises means for operating the locking of the connecting means of the container.

8. A beer container according to claim 1, characterized in that means are provided for detachably locking the housings of containers disposed one above the other.

9. A beer container according to claim 1, characterized in that the barrel has a cylindrical shape.

10. A beer container according to claim 1, characterized in that the dimensions of the bottom surface of the housing are 30×40 cm.

11. A beer container according to claim 1, characterized in that the housing comprises a handgrip on each short side thereof.

* * * * *